US006637683B1

(12) United States Patent
(Lomax) Wilbur

(10) Patent No.: US 6,637,683 B1
(45) Date of Patent: Oct. 28, 2003

(54) HAND-HELD TABLET (PILL) CRUSHER

(76) Inventor: Dimitria Michelle (Lomax) Wilbur, 9504 Ocala St., Silver Spring, MD (US) 20901

( * ) Notice: Subject to any disclaimer, the term of this patent is extended or adjusted under 35 U.S.C. 154(b) by 0 days.

(21) Appl. No.: 10/101,904

(22) Filed: Mar. 20, 2002

Related U.S. Application Data

(60) Provisional application No. 60/298,976, filed on Jun. 18, 2001.

(51) Int. Cl.[7] ..... B02C 19/08

(52) U.S. Cl. ..... 241/101.2; 241/169.2; 241/DIG. 27

(58) Field of Search ..... 241/169.2, DIG. 27, 241/101.4, 101.2

(56) References Cited

U.S. PATENT DOCUMENTS

| | | | | |
|---|---|---|---|---|
| 4,003,523 | A | | 1/1977 | Doolittle |
| 4,121,775 | A | | 10/1978 | Roseberg et al. |
| 4,209,136 | A | | 6/1980 | Linden et al. |
| 4,366,930 | A | | 1/1983 | Trombetti, Jr. |
| D285,966 | S | | 9/1986 | Porter |
| 4,765,549 | A | | 8/1988 | Sherman |
| D310,564 | S | | 9/1990 | Besaw |
| D310,731 | S | | 9/1990 | Lieptz |
| 4,967,971 | A | | 11/1990 | Smith |
| 5,025,996 | A | | 6/1991 | Lavin et al. |
| 5,067,666 | A | | 11/1991 | Sussman |
| 5,123,601 | A | | 6/1992 | Lavin et al. |
| 5,148,995 | A | * | 9/1992 | Hurst ..... 241/30 |
| 5,178,337 | A | | 1/1993 | Lupoli |
| D337,828 | S | | 7/1993 | Gordon |
| 5,322,227 | A | | 6/1994 | Fiocchi |
| 5,531,386 | A | | 7/1996 | Jensen |
| 5,823,451 | A | | 10/1998 | Sharpe |
| 5,863,001 | A | | 1/1999 | Schulze |
| D405,889 | S | | 2/1999 | Parsons |
| 5,915,637 | A | | 6/1999 | Parsons |
| 5,924,636 | A | | 7/1999 | Calderon |
| 6,059,209 | A | | 5/2000 | Barson |
| D433,148 | S | | 10/2000 | Dennis |

OTHER PUBLICATIONS

"Ezy Dose", Tablet Crusher with Pill Container drugstore-.com, Apothecary Products.

* cited by examiner

*Primary Examiner*—Mark Rosenbaum

(57) ABSTRACT

A hand-held pill crusher (20) with an arm (11) and base(10) made of a hard and impervious material connected at one end so as to allow a vertical open and close movement to fragment and then crush pill into powdered form. The arm contains a plurality of stainless steel blades (18) for fragmenting pill and a crushing member (15) made of similar hard and impervious material for reducing fragments to powder. The base contains a pill rack (13), threaded recess (14) for crushing member and a track (17) on underside for holding spoon-like receiving member (16).

1 Claim, 3 Drawing Sheets

HAND-HELD TABLET (PILL) CRUSHER

CROSS-REFERENCE TO RELATED APPLICATION

This application is entitled to the benefit of Provisional Patent Application Ser. No. 60/298,976 filed Jun. 18, 2001.

BACKGROUND

1. Field of Invention

This invention relates to a hand-held pill crushing apparatus. It is intended to aid persons who are unable to swallow medicines in pill form and healthcare providers who have the task of crushing pills. This apparatus would eliminate the tedious process of crushing pills and tablets into a powdered form. This device can also be used in the field of veterinary medicine.

BACKGROUND

2. Description of Prior Art

There are manual ways to crush pills into a powdered form, however, elderly persons or persons who have undergone recent surgery may not have the strength necessary to crush pills using the traditional methods.

For example, U.S. Pat. No. 5,924,636 to Calderon (1999) shows a hand-held pill crusher that requires the user to apply force in excess of that which an elderly person or someone who has undergone recent surgery may not have. As shown in FIG. 4 of Calderon's patent, apertures 18A within the receiving member 18 would become clogged during the crushing process so that the powdered pill would not be able to fall through the apertures. Arthritic and post-surgery patients would have similar difficulty in applying the squeezing action necessary to operate the devices described in U.S. Pat. Nos. 4,003,523 to Doolittle (1977) and 5,178,337 to Lupoli (1993). The pressure necessary to operate the devices disclosed by U.S. Pat. Nos. 5,915,637 and D405,889 to Parsons (1999) requires that user be able to apply his or her body weight to the device. Also, it appears that the use of the pouch (FIG. 6) required thereby would cause a loss of the prescribed dosage by (1) fragments of pills lodged within the indentations in the pouch due to the pressing action of the device and (2) powder adhering to the pouch as it is poured. Operationally, the device shown by U.S. Pat. No. 6,059,209 to Barson (2000) also requires the use of one's body weight. This may prove difficult for persons who have recently undergone surgery. It is also noted that the preferred embodiment of the Barson patent uses paper cups. The residue of pills may remain in the paper cups leading to a loss of the prescribed dosage. Paper cups are also likely to become punctured during the pressing process. Although Barson states that the apparatus can be operated without paper cups, use of the crushing bowl that is taught alone would likely cause cross contamination if used for multiple medications.

U.S. Pat Nos. D337,828 to Gordon (1993) and D433,148 to Dennis (2000) show ornamental designs of a pill crusher that use a screwing technique to crush pills. These designs also would require excessive strength to crush solid tablets into a powdered form. A review of U.S. Pat. No. 4,765,549 to Sherman (1988) reveals a device similar to the patents of Gordon and Dennis, but containing protrusions either on the mortar or on the pestle for crushing tablets. The interior design of the mortar in Sherman's patent, which is threaded internally, is such that the prescribed dosage once in powdered form would be lessened when it was transferred to another receptacle because it would tend to adhere to the internal threads.

U.S. Pat. No. 5,067,666 to Sussman (1991) teaches a battery-operated portable pill crushing device. Although this device is portable, its size appears to be somewhat bulky and awkward for individual usage.

U.S. Pat. No. D310,731 to Lieptz (1990) shows an ornamental design for a pill splitter which is used to divide a single pill in half. However, depending on the size of the pill, it may need to be split more than once, requiring repeated uses of the device.

The combination of the simultaneous downward thrust and turning of the crushing member of the device shown in U.S. Pat. No. 4,366,930 to Trombetti, Jr. (1983) is similar to the process that is used for child safety caps for medication. Elderly and arthritic persons find this process difficult to manage.

Other pill crushing or pulverizing references that applicant is aware of are as follows: U.S. Pat. No. 5,531,386 to Jensen (1996); U.S. Pat. No. 5,123,601 to Lavin, et al. (1992); U.S. Pat. No. 4,967,971 to Smith (1990); U.S. Pat. No. D310,564 to Besaw (1990); U.S. Pat. No. D285,966 to Porter (1986); U.S. Pat. No. 4,209,136 to Linden, et al. (1980); and U.S. Pat. No. 4,121,775 to Roseberg, et al. (1978).

In conclusion, there are many patents for pill/tablet crushing devices; however, all exhibit various problems and defects addressed by the present invention.

SUMMARY

In the preferred embodiment of the invention, a hand-held pill crusher is an apparatus which uses a two-step process: first dividing the pill into smaller fragments and second, crushing the fragments into a powdered state. More specifically, through a closing action, blades contact a medication pill located on a pill rack to fragment the pill, and the fragments are then passed along to a crushing member where through a screwing technique the pill fragments are crushed into a powdered state.

Objects and Advantages

This two-step process is easy on the user in that less pressure is needed to crush fragments into powder than to crush a whole pill into powder.

The objects and advantages of this hand-held pill crusher are to provide a means to crush solid pills with less force, to provide an easy to clean instrument to prevent cross contamination of medicines, and to minimize loss of dosage. This device is hand-held and lightweight, easy to use, portable and economical. Further objects and advantages will become apparent from review of the drawings, descriptions and operation of the hand-held pill crusher of the invention.

DRAWING FIGURES

DESCRIPTION

Figure 1:
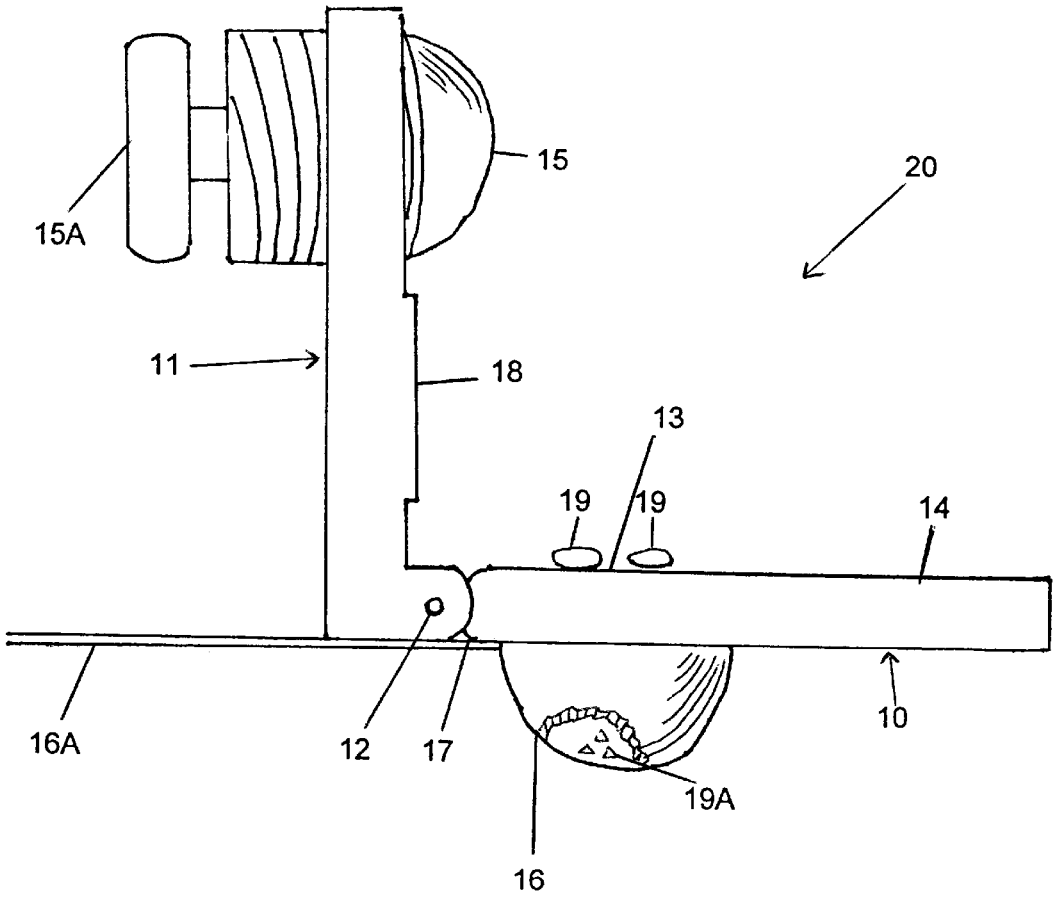
FIG. 1 is a side elevational view of the preferred embodiment of the hand-held pill crusher of the invention in open condition, ready to receive a pill to be crushed.

FIG. 1 is a side elevational view of a pill crusher 20 according to the invention, shown in the open condition ready to receive a pill. It consists of a base 10 and an arm 11, which are connected by a pin 12, which allows arm 11 to freely open and close vertically. Pill crusher 20 is relatively small in dimension, of a size to be hand-held during operation. Base 10 contains an embedded pill rack 13 shown better in FIG. 2, to hold a pill 19 and a threaded recess 14 to receive the screw of crushing member 15. Under base 10 is a spoon-like receiving member 16, which is inserted by sliding into a track 17 from rear of base 10. In use, receiving member 16 is initially positioned under pill rack 13 in the position shown in FIG. 1, to receive a fractured pill 19A; it is then moved further along track 17 (rightwardly in FIG. 1) to a stop position to prepare for crushing member 15. Receiving member 16 is also the receptacle for the powdered pill. Arm 11 contains a multiple blade feature 18, which when it makes contact with pill 19 located on pill rack 13 fractures pill 19A. After pill 19 is fractured and falls into receiving member 16, receiving member 16 is moved along track 17 to position under threaded recess 14. Crushing member 15 is then forced toward base 10 in a screw-like manner by the continued turning of the handle 15A, threaded into base 10. As crushing member 15 presses against fractured pill 19A within receiving member 16, the contents are changed into a powdered form.

When the crushing process is complete, handle 15A is turned in the reverse to release receiving member 16. Receiving member 16 is then removed from base 10 along track 17. Receiving member 16 is then used to administer the powdered pill without loss of measured dosage.

Figure 2:
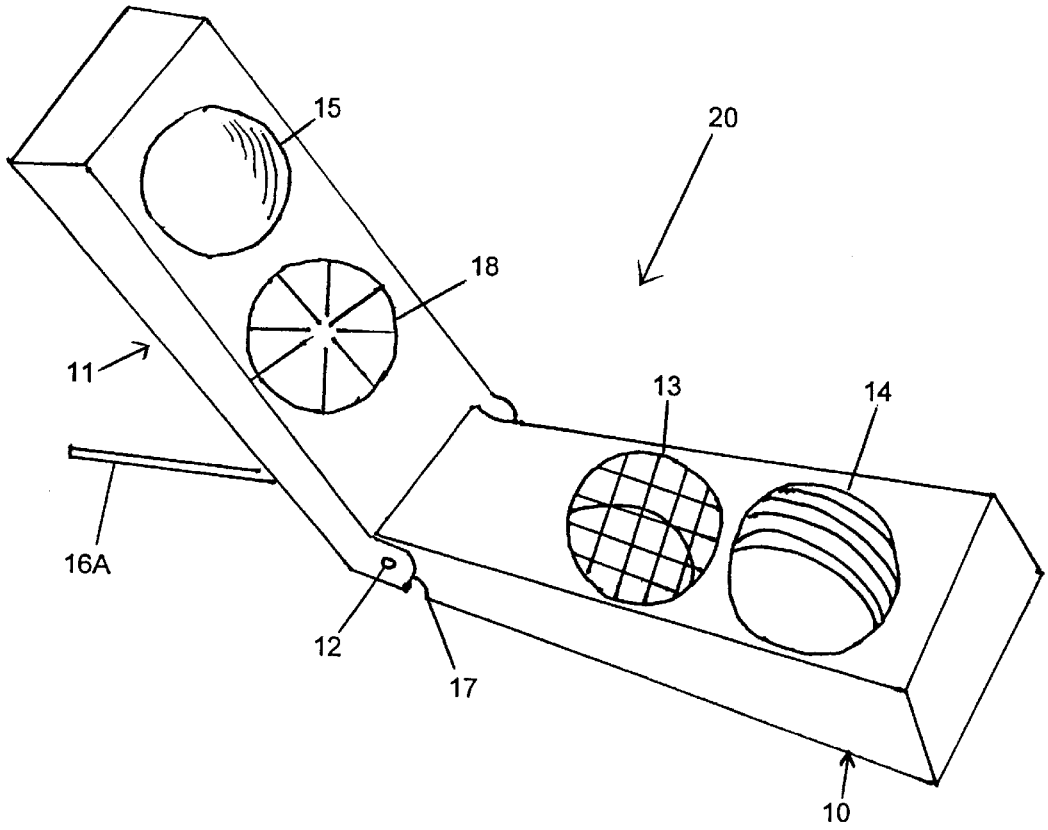
FIG. 2 is a top perspective view of the device of FIG. 1, in open condition.

FIG. 2 is a top perspective view of the device of FIG. 1, in open condition showing base 10 and arm 11 connected by pin 12 which will allow pill crusher 20 to open and close vertically. Arm 10 contains multiple blades 18 and crushing member 15. Base 10 contains embedded pill rack 13 and threaded recess 14 for engaging crushing member 15. Underneath base 10 is track 17 for which spoon-like receiving member 16 slides. Receiving member 16 has a handle 16A for manipulation.

Figure 3:
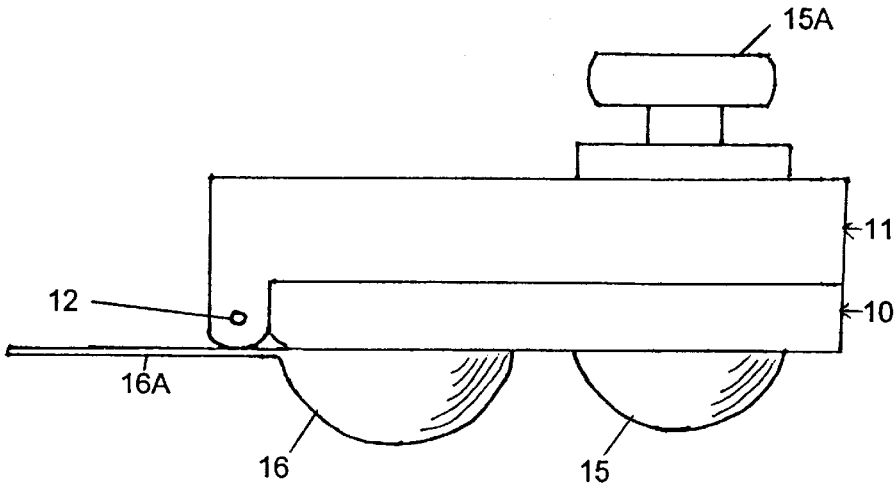
FIG. 3 is a side elevational view of the hand-held pill crusher of the invention in closed condition.

FIG. 3 is a side elevational view of hand-held pill crusher in closed condition, the opposite side view being a mirror image of that shown. Arm 11 is closed upon base 10. In closed condition, crushing member 15 is shown screwed in place by handle 15A through threaded recess 14, with crushing member 15 protruding through threaded recess 14. Also shown is spoon-like receiving member 16 in place under pill rack 13.

Figure 4:
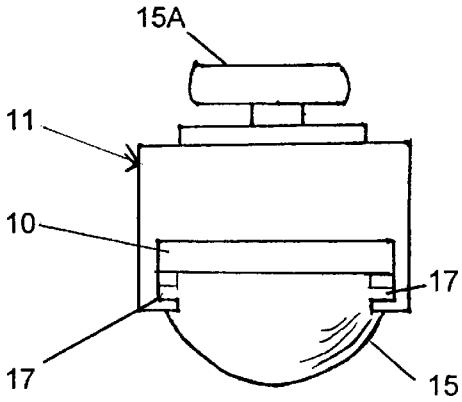
FIG. 4 is a rear elevational view of the device, without the receiving member.

FIG. 4 is a rear elevational view of FIG. 3, without receiving member 16, which shows track 17 along which spoon-like receiving member 16 slides back and forth. Also shown is handle of crushing member 15A used to screw crushing member 15 into spoon-like receiving member 16.

Figure 5:
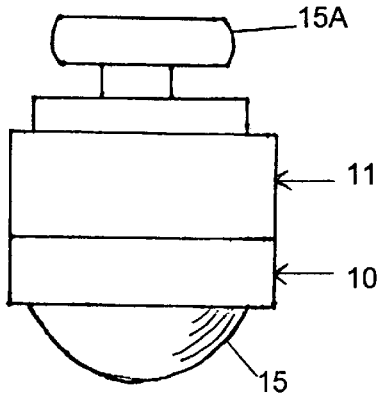
FIG. 5 is a front elevational view of the device.

FIG. 5 is a front elevational view of FIG. 3 which shows direct view of crushing member 15 protruding through threaded recess 14 in base 10.

Operation:

To operate hand-held pill crusher 20, the operator places spoon-like receiving member 16 along track 17 through the rear of the pill crusher so that it is positioned under pill rack 13.

The pill crusher 20 is opened and pill 19 placed on pill rack 13. The pill crusher is then closed. When multiple blades 18 contact pill 19 located on pill rack 13, pill fragments 19A fall into spoon-like receiving member 16.

The operator then slides spoon-like receiving member 16 along track 17 to threaded recess 14. While pill crusher 20 is in closed position, operator begins turning handle 15A of crushing member 15 until it makes contact with pill fragments 19A within spoon-like receiving member 16 and until powdered condition is formed.

Handle of crushing member 15A is screwed in reverse manner to release contact with spoon-like receiving member 16. Operator then removes powdered pill by sliding spoon-like receiving member 16 along track 17 toward the back of pill crusher 20.

Powdered pill can then be dispensed directly from the spoon-like receiving member 16 into liquid or food mixture of patient, without loss of dosage.

Conclusion, Ramifications, and Scope

Based on the previous discussion set forth, the reader can see that this invention for crushing pills and tablets into powdered form requires minimal brut force and pressure on the part of the user. It is also easy to use, easy to clean and economical. Its size also makes it lightweight and portable.

There are also variations on the materials that can be used to produce this embodiment such as stainless steel, impervious plastics, etc. Also the multiple blade feature can consist of two or more blades. With respect to the manner in which the arm and base are connected in the illustrated embodiment, other connections can also be used.

Accordingly, the scope of the invention should not be determined by the illustrated embodiment, but by the appended claims and their legal equivalents.

I claim:

1. A hand-held pill crusher, comprising:

a. an arm, b. a base, and c. means for adjoining said arm and base at one end whereby said arm and base opens and closes adjacently;

d. said arm includes both a pill fragmenting means located near adjoined end of said arm and a crushing member located near open end;

e. said pill fragmenting means is a plurality of blades;

f. said base includes two recesses; a first recess located near adjoined end of said base; and a second recess located near open end whereby said crushing member protrudes when engaged with said base;

g. said first recess is a rack whereby a pill can be placed thereupon;

h. said second recess is threaded whereby receiving said crushing member;

i. said base includes a track located on underside whereby a receiving member moves back and forth from said first and second recesses;

j. said track is closed on one end whereby creating a stop for the receiving member;

k. said receiving member is a spoon-like receptacle.

* * * * *